US007121695B2

(12) United States Patent
Wu

(10) Patent No.: US 7,121,695 B2
(45) Date of Patent: Oct. 17, 2006

(54) STRUCTURE RAPID ASSEMBLY/DISASSEMBLY LAMP SHADE

(76) Inventor: Wen-Chang Wu, No. 10, Lane 191, Sisin St., Chuangya Vil., Sioushuei Township, Changhua County 50443 (TW)

( * ) Notice: Subject to any disclaimer, the term of this patent is extended or adjusted under 35 U.S.C. 154(b) by 52 days.

(21) Appl. No.: 10/979,322

(22) Filed: Nov. 3, 2004

(65) Prior Publication Data

US 2006/0092645 A1 May 4, 2006

(51) Int. Cl.
*F21V 1/06* (2006.01)

(52) U.S. Cl. ..... 362/352; 362/357

(58) Field of Classification Search ..... 362/351–352, 362/357, 360–361; 248/230.7–230
See application file for complete search history.

(56) References Cited

U.S. PATENT DOCUMENTS 6,315,434 B1 * 11/2001 Long ..... 362/352
6,517,220 B1 * 2/2003 Wu ..... 362/352
6,540,383 B1 * 4/2003 Wu ..... 362/450
6,698,910 B1 * 3/2004 Wu ..... 362/352
6,851,836 B1 * 2/2005 Chou ..... 362/352

* cited by examiner

*Primary Examiner*—Ali Alavi
(74) *Attorney, Agent, or Firm*—Troxell Law Office, PLLC

(57) ABSTRACT

An improved structure rapid assembly/disassembly lamp shade consisting of a double-layer type lamp shade design in which the outer layer lamp shade rests on a plurality of support rods the length of the lamp shade insertionally coupled to the bottom ring and, furthermore, the support rods are upwardly whorl-folded relative to the axial center of the bottom ring such that the support rod top sections are inwardly against the bottom edge of the outer layer lamp shade top ring. Additionally, a top support frame is disposed at the apex of the inner layer lamp shade and, furthermore, the top support frame provides for light bulb mounting. Among the features, after each of the support rods are coupled to the outer layer lamp shade top ring, insertional offset slots are formed along the bottom edge of the outer layer lamp shade top ring that provides for the engagement of the inner layer lamp shade top support frame to thereby keep the circumferential rim of the inner layer lamp shade top support frame tightly positioned in the insertional offset slot. As such, the present invention achieves assembly and disassembly that is both convenient and rapid. Furthermore, the top and bottom rings as well as the inner and outer layer lamp shades are all collapsible into a flat state to reduce storage and shipping dimensions and thereby effectively reduce shipping costs.

3 Claims, 8 Drawing Sheets

STRUCTURE RAPID ASSEMBLY/DISASSEMBLY LAMP SHADE

BACKGROUND OF THE INVENTION

1) Field of the Invention

The invention herein relates to an improved structure rapid assembly/disassembly lamp shade in which after the support rods are coupled to the outer layer lamp shade top ring, insertional offset slots are formed along the bottom edge of the outer layer lamp shade top ring that provide for the engagement of the inner layer lamp shade top support frame to thereby keep the circumferential rim of the inner layer lamp shade top support frame tightly positioned in the insertional offset slots. As such, the present invention thereby achieves assembly and disassembly that is both convenient and rapid. Furthermore, the top and bottom rings as well as the inner and outer layer lamp shades are all collapsible into a flat state to reduce storage and shipping dimensions and thereby effectively reduce shipping costs.

2) Description of the Prior Art

In prior art lamp shades, the support rods are typically conjoined between the top ring and the bottom ring in a permanent state and, as such, since the lamp shade cannot be collapsed when packaged, the product occupies a considerably larger space, resulting in increased storage and shipping dimensions as well as the associated costs. Therefore, the applicant of the invention herein researched and developed a kind of collapsible lamp shade structure, specifically the "Improved Structure Rapid Assembly/Disassembly lamp Shade" filed under U.S. Pat. No. 6,523,981 and which consists of frame members 3 coupled onto the bottom ring 21 of a lamp shade 4 and, furthermore, the frame members 3 are capable of being whorled centrally over the bottom ring 2 and situated against the lower edge of the top ring 1, enabling the top ring 1, the bottom ring 2, and the frame members 3 to become arranged into a single structural entity. However, due to the exterior fabric surface layer 41 of the lamp shade 4, the said assembly approach requires support rods 11 extending towards the center as well as a mounting hole 121 formed in the middle of the support rods 11 such that when the exterior fabric surface layer 41 inner top ring 1A is raised, a threaded stud 141 and a nut 15 are fastened to maintain the position, resulting in an assembly procedure that necessarily involves the troublesome fastening of the threaded stud 141.

BRIEF DESCRIPTION OF THE DRAWINGS

FIG. 1-A is partially magnified view of FIG. 1.

FIG. 2-A is a partially magnified view of FIG. 2.

FIG. 3-A is a partially magnified view of FIG. 3.

FIG. 6-A is a partially magnified view of FIG. 6.

FIG. 7-A is a partially magnified view of FIG. 7.

DETAILED DESCRIPTION OF THE PREFERRED EMBODIMENTS

Figure 1:
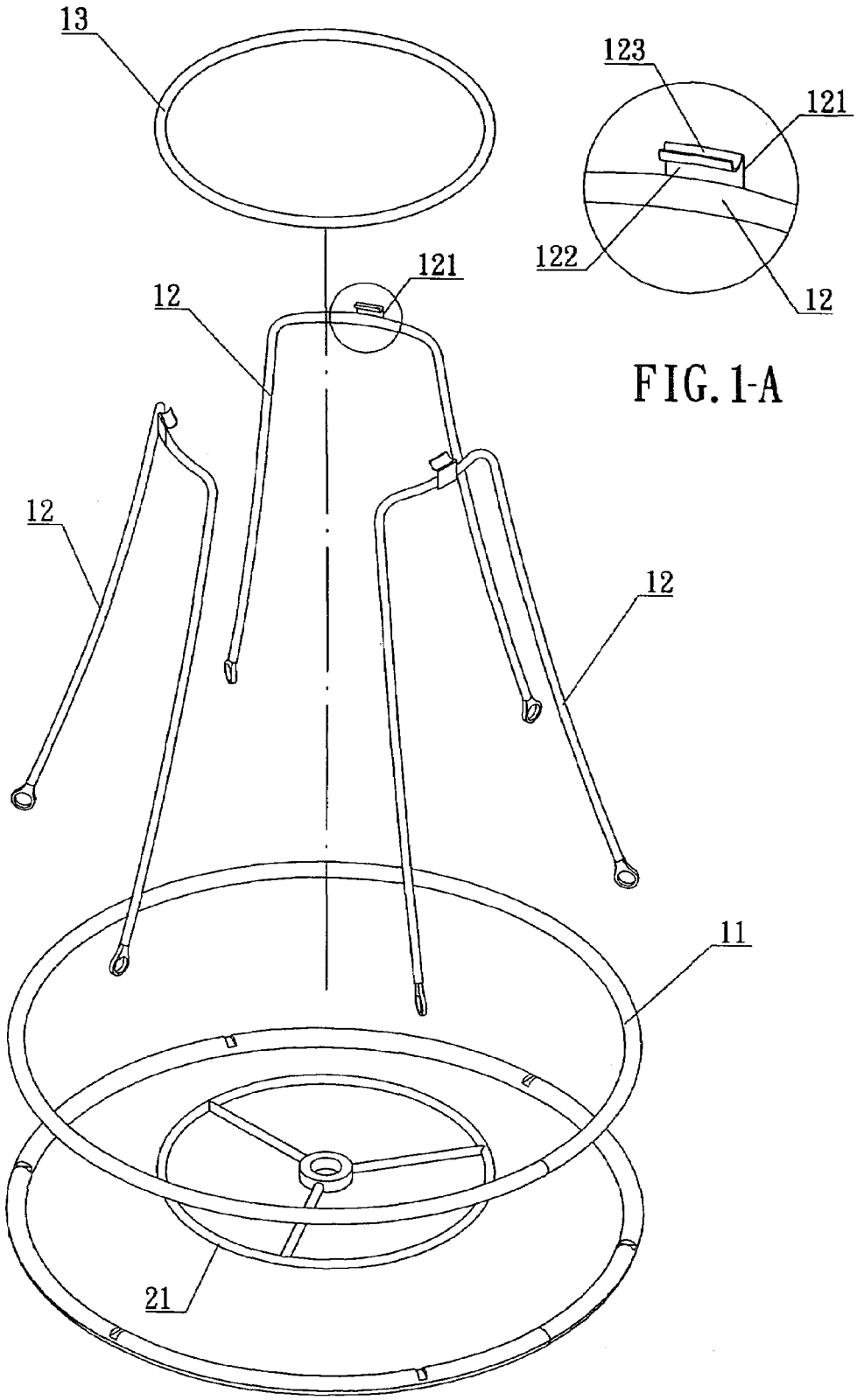
FIG. 1 is an exploded drawing of the invention herein.
Figure 2:
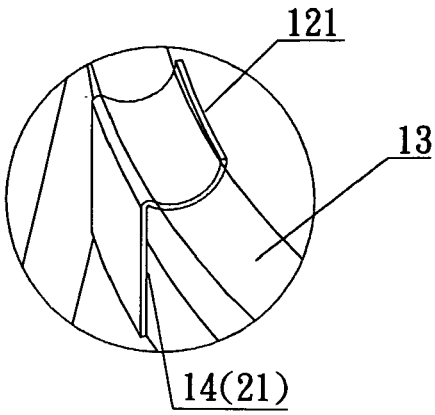
FIG. 2 is an isometric drawing of the invention herein.
Figure 2:
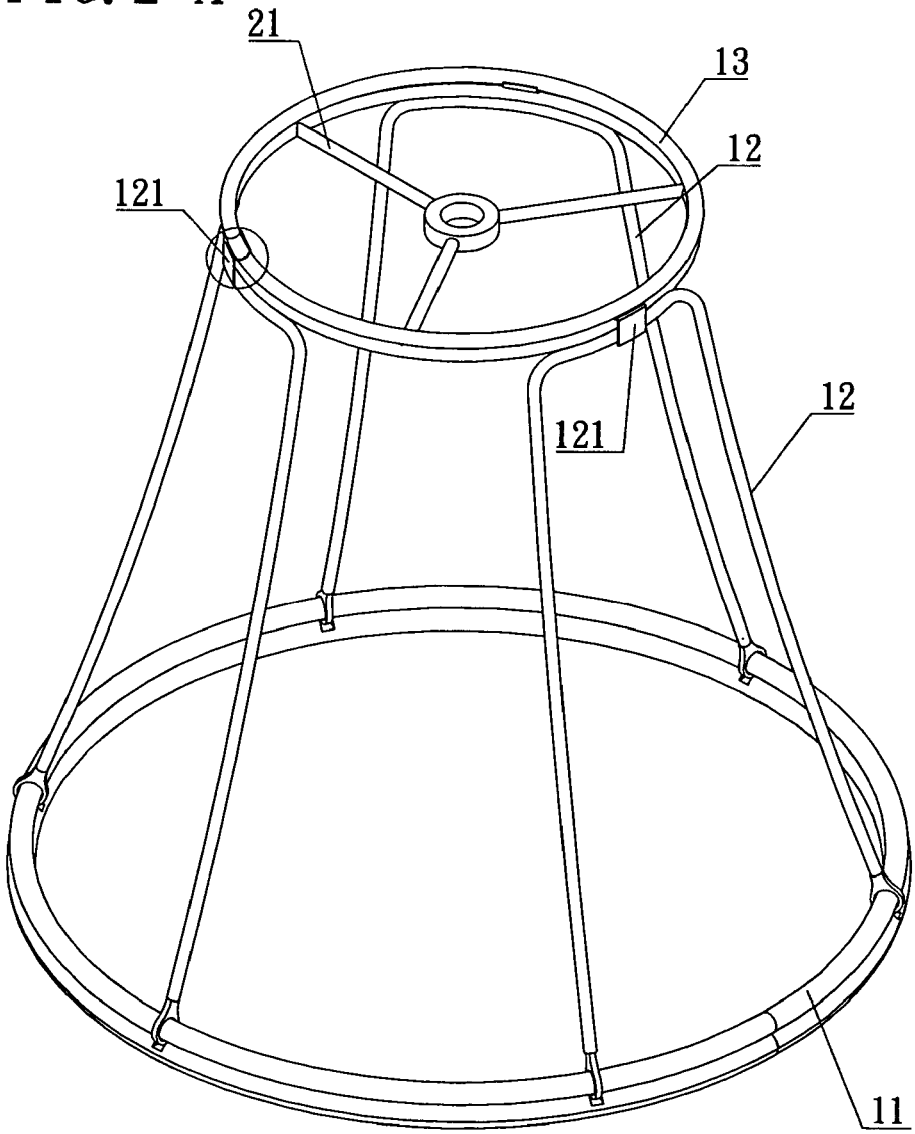
Figure 3:
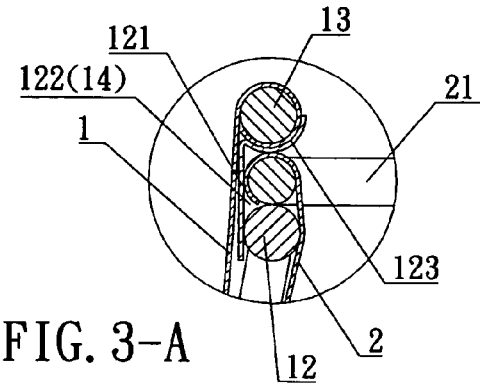
FIG. 3 is a cross-sectional drawing of the invention herein.
Figure 3:
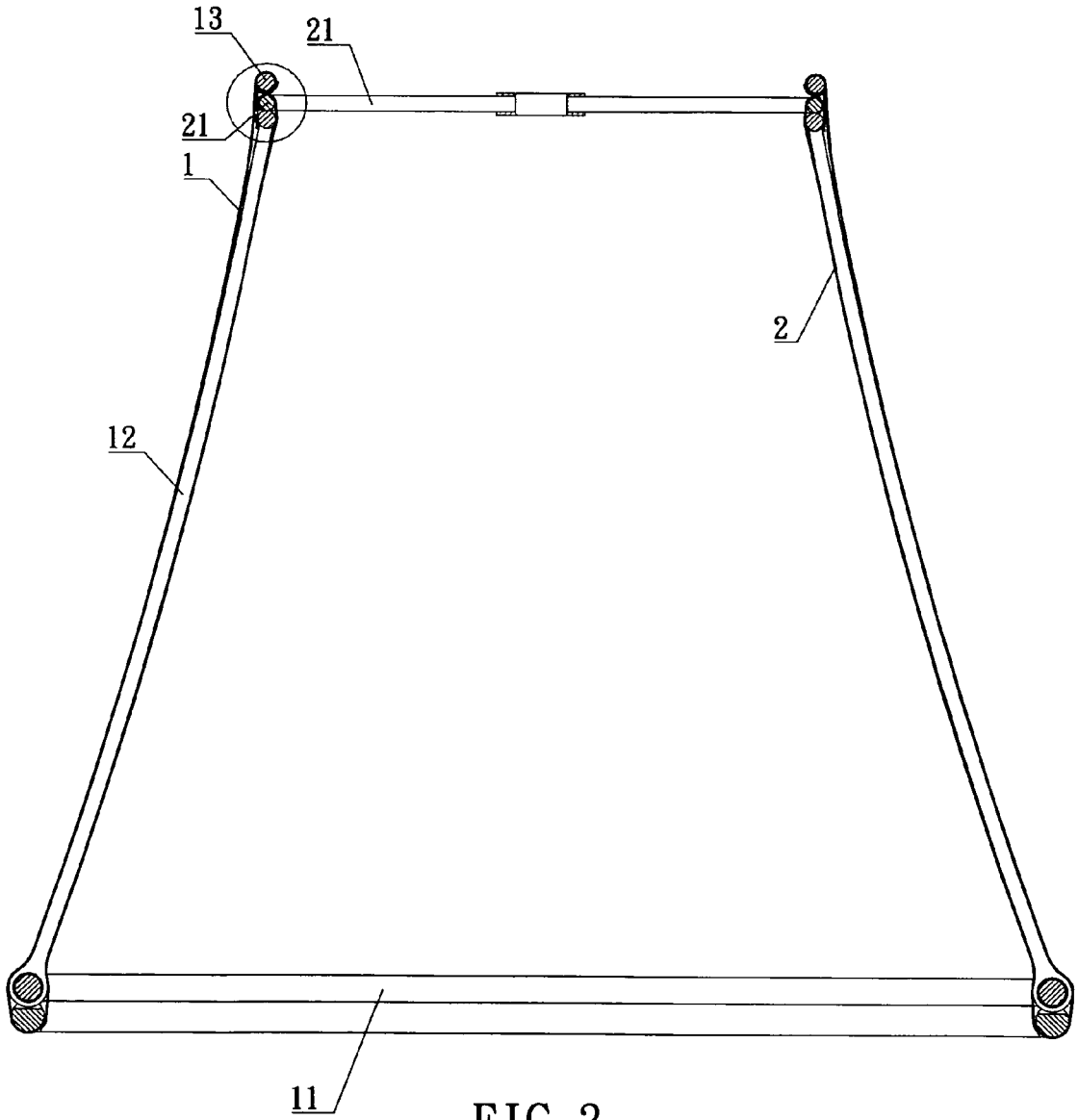
Figure 4:
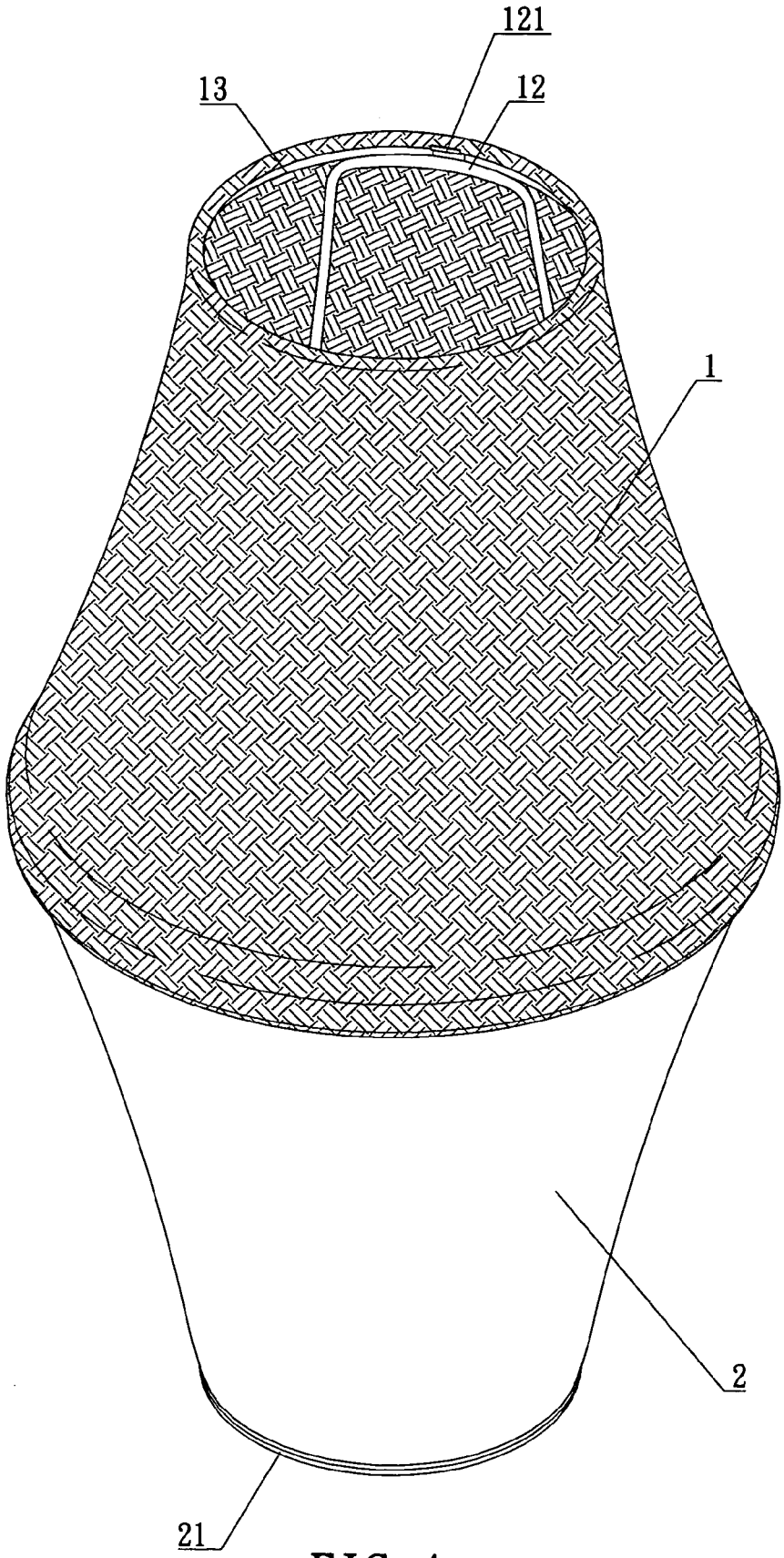
FIG. 4 is an isometric drawing of the invention herein when the inner and the outer layer lampshades are separated.
Figure 5:
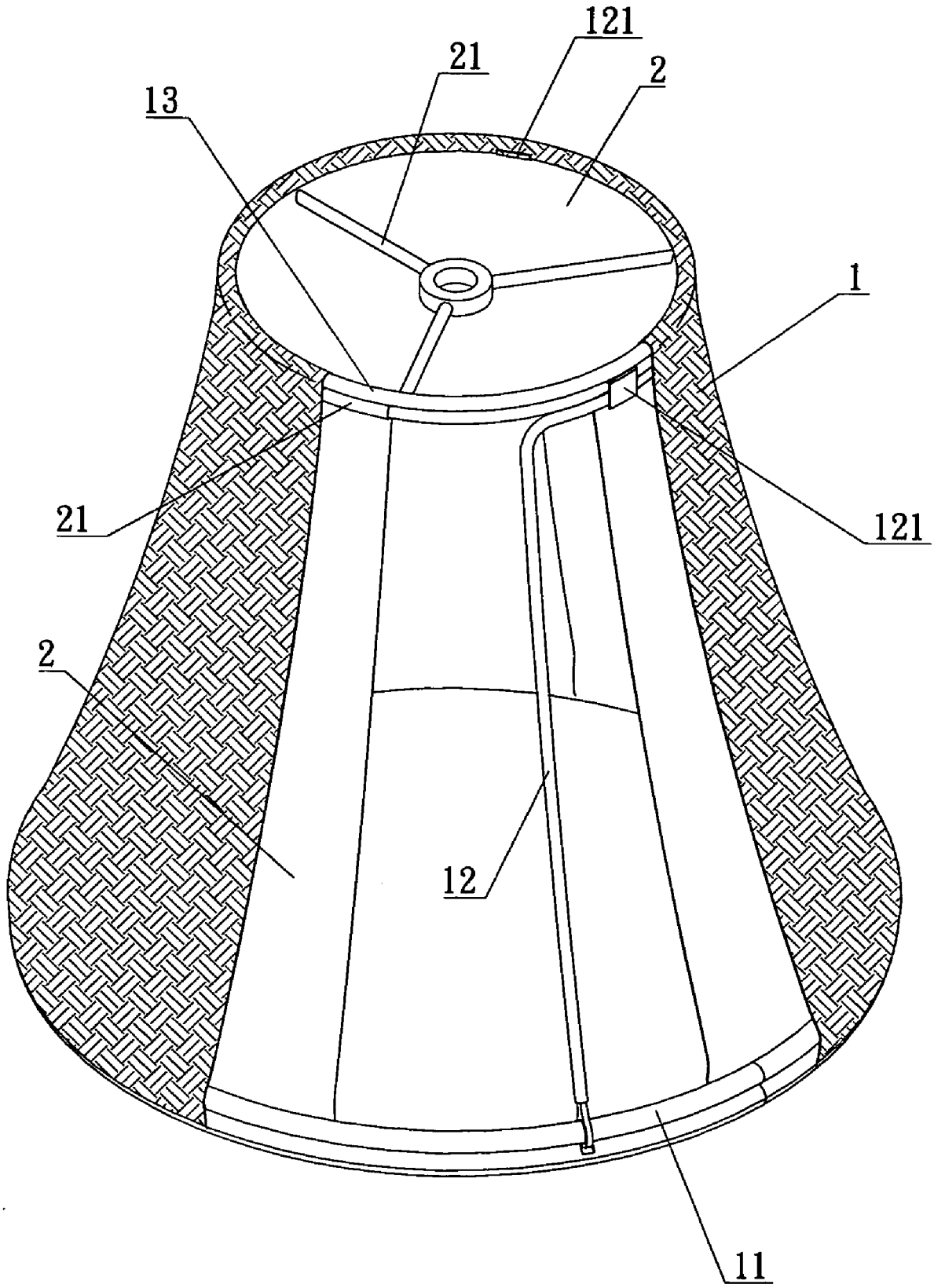
FIG. 5 is an isometric drawing of the invention herein when the inner and outer layer lampshade are flush.

Referring to FIG. 1, FIG. 1-A, FIG. 2, FIG. 2-A, FIG. 3, FIG. 3-A, FIG. 4, and FIG. 5, the structural arrangement of the invention herein consists of a double-layer type lamp shade construct in which the outer layer lamp shade 1 rests on a plurality of support rods 12 the length of the lamp shade 1 insertionally coupled to the bottom ring 11, providing for the upward whorl-folding of the support rods 12 relative to the axial center of the bottom ring 11 such that the support rod 12 top sections are inwardly against the bottom edge of the outer layer lamp shade 1 top ring 13; additionally, a top support frame 21 is disposed at the apex of the said inner layer lamp shade 2 and, furthermore, the top support frame 21 has a threaded hole 211 at its center, the said threaded hole 211 providing for light bulb mounting.

The features of the present invention are: Each support rod 12 is of a predetermined length that is slightly lower than that of the lamp shade 1 and, furthermore, a clip tab 121 protrudes at the center of the uppermost curved rod of each support rod 12 such that after each said clip tab 121 is admitted into the catch slot 122 situated along the top support frame 21, and thereby fitted into a receding edged, insertional retaining slot 123 at the top end, as well as the coupling of the outer layer lamp shade 1 top ring 13 to the support rods 12, the insertional retaining slots 123 engage the bottom end of the top ring 13 to thereby posture the top ring 13 and the bottom ring 11 against the interior side of the lamp shade 1; furthermore, an insertional offset slot 14 is formed in the catch slot 122 at the bottom edge of the insertional retaining slots 123 that provides for the engagement of the inner layer lamp shade 2 top support frame 21 to thereby keep the circumferential rim of the inner layer lamp shade 2 top support frame 21 tightly positioned in the insertional offset slot 14.

Figure 6:
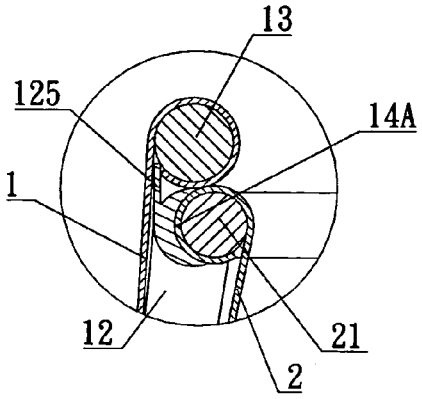
FIG. 6 is a cross-sectional drawing of the second embodiment of the invention herein.
Figure 6:
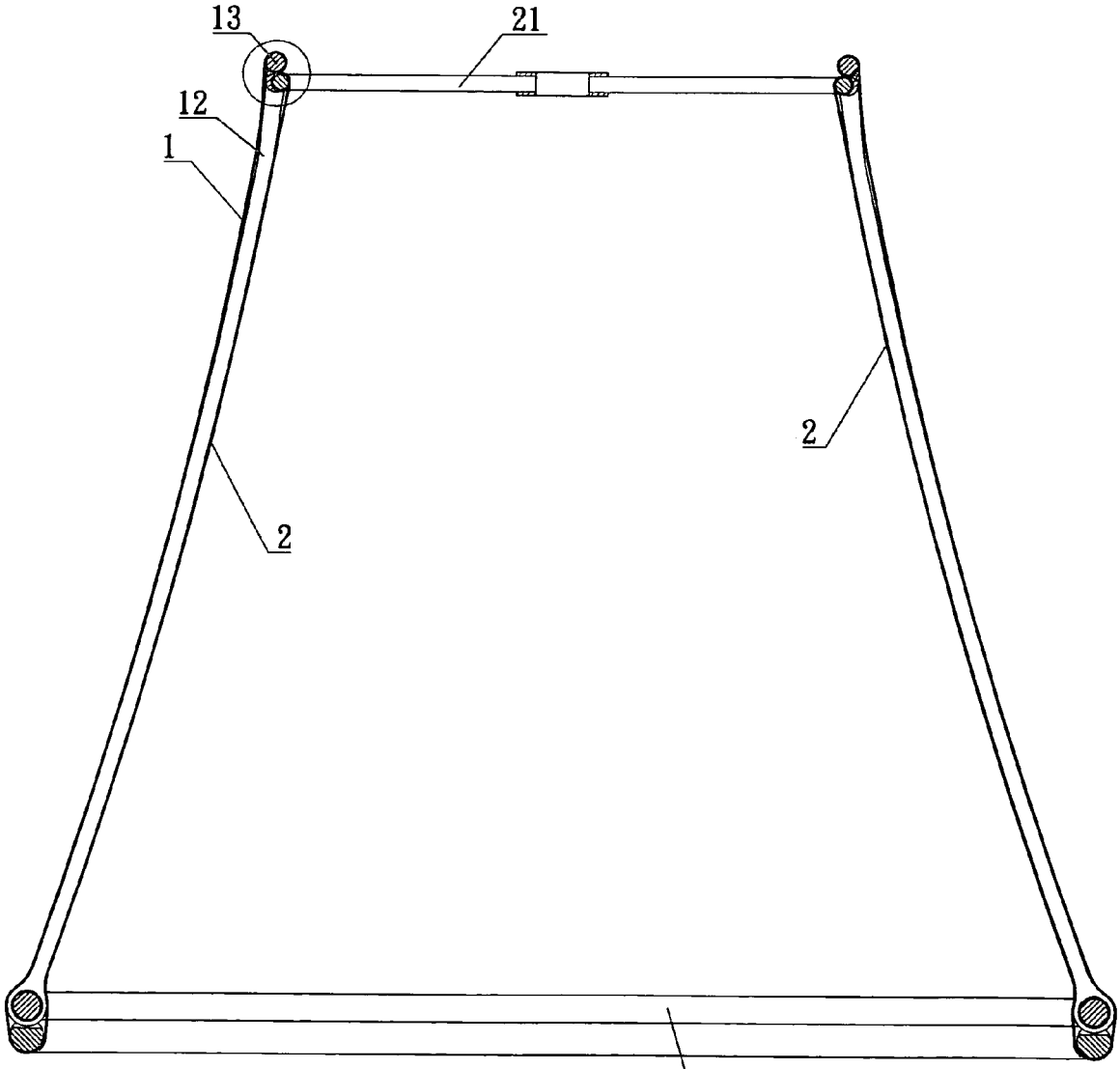

Referring to FIG. 6 and FIG. 6-A, the drawings of another embodiment of the invention herein, the features of which are: A clasp tab 125 is disposed on the buttressing top section extending horizontally from each support rod 12 such that after the outer layer lamp shade 1 top ring 13 and the support rods 12 are coupled, the clasp tabs 125 engage the top ring 13 bottom end to thereby posture the top ring 13 and the bottom ring 11 against the interior side of the lamp shade 1; furthermore, an insertional offset slot 14 is recessively disposed at the intersection of the curved top rod 124 and the straight rod 126 of the support rods 12 to keep the circumferential rim of the inner layer lamp shade 2 top support frame 21 tightly positioned in the insertional offset slot 14A.

Figure 7:
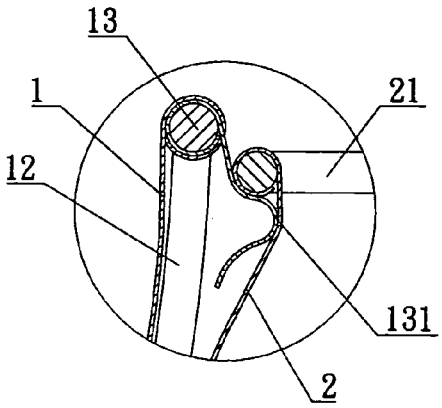
FIG. 7 is a cross-sectional drawing of the third embodiment of the invention herein.
Figure 7:
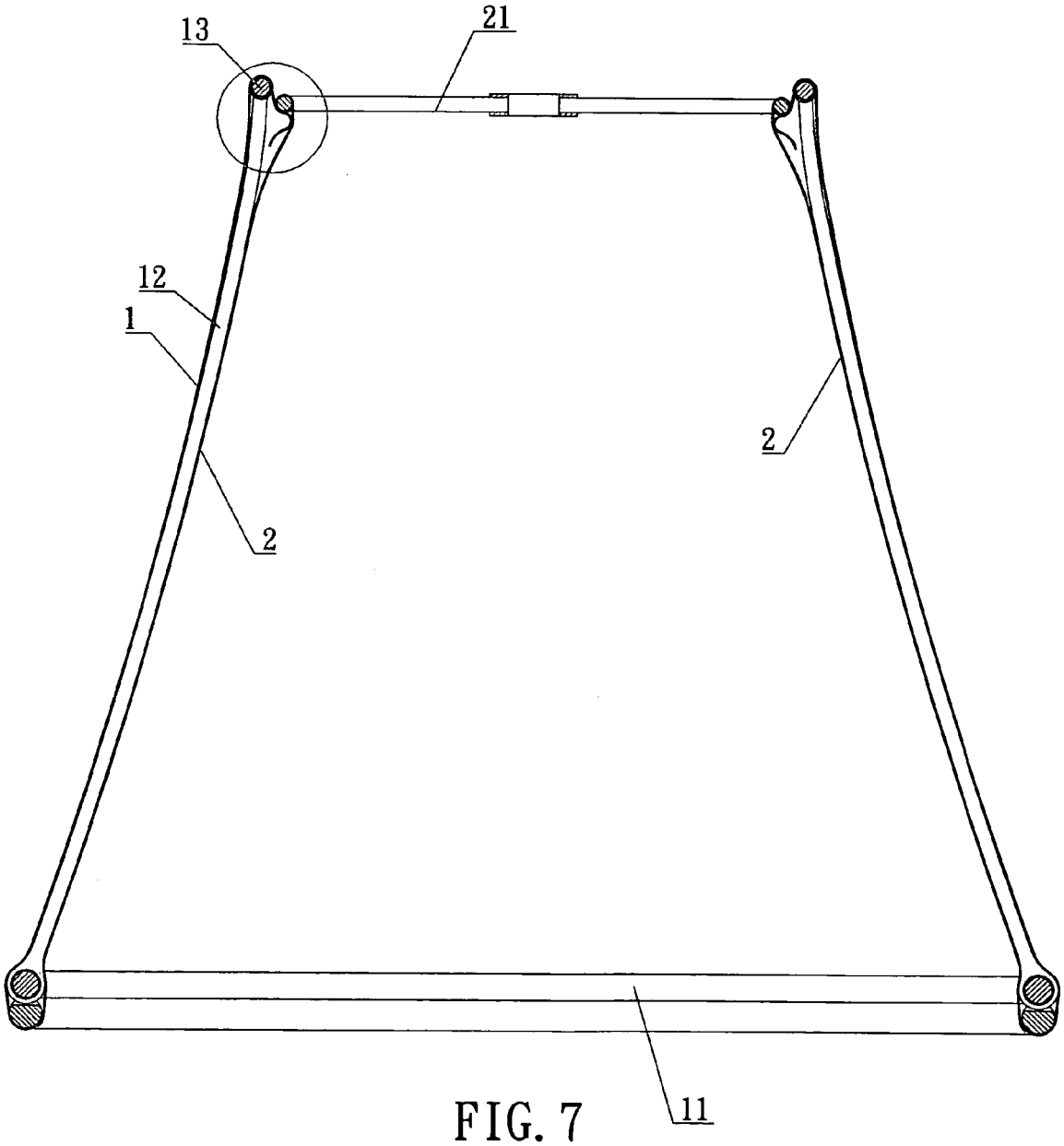
Figure 8:
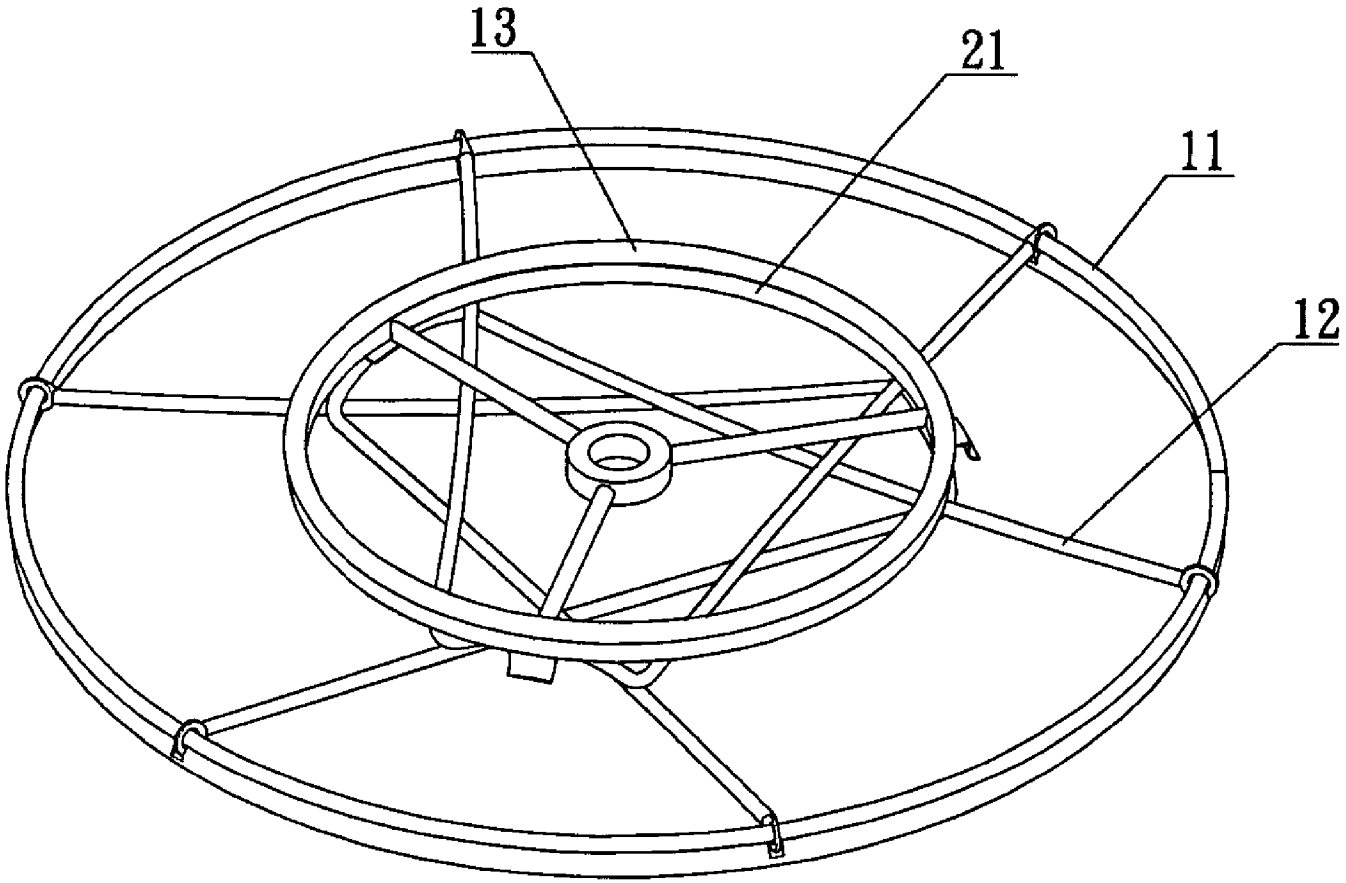
FIG. 8 is an isometric drawing of the invention herein in the collapsed state.

As such, following the insertion of the inner layer lamp shade 2 and the outer layer lamp shade 1 into the insertional offset slot 14 and 14A, the circumferential rim of the top support frame 21 on the said inner layer lamp shade 2 is firmly positioned in the said insertional offset slot, thereby achieving assembly and disassembly that is both convenient and rapid; furthermore, the top and bottom rings 13 and 11 as well as the inner and outer layer lamp shades 2 and 1 are all collapsible into a flat state (as shown in FIG. 7) to reduce storage and shipping dimensions and thereby effectively reduce shipping costs.

Referring to FIG. 7 and FIG. 7-A, the drawings of yet another embodiment of the invention herein, the features of which are: An elastic tab 131 is sleeved onto the circumferential rim of the said outer layer lamp shade 1 top ring 13 at the position of every other support rod 12, the said elastic tabs 131 extending downward such that when inner lamp shade 2 top support frame 21 is upwardly engaged by insertion to the top ring 13, the top support frame 21 is engaged at the lower extent of the elastic tabs 13, and insertionally maintained in position on the outer layer lamp shade 1.

The invention claimed is:

1. An improved structure rapid assembly/disassembly lamp shade consisting of a double-layer type lamp shade design in which an outer layer lamp shade rests on a plurality of support rods the length of the said lamp shade insertionally coupled to a bottom ring and, furthermore, the said support rods are upwardly whorl-folded relative to the axial center of the said bottom ring such that the top sections of the said support rods are inwardly against the bottom edge of a top ring of the said outer layer lamp shade, additionally, a top support frame is disposed at the apex of the said inner layer lamp shade and, furthermore, the said top support frame provides for light bulb mounting, the features of which are: an arcuate slot is formed on the uppermost curved rod extending from the buttressing top section of each said support rod such that after the said support rods are assembled into the said outer layer lamp shade, insertional offset slots are naturally formed along the bottom edge of the said outer layer lamp shade top ring that provides for the insertion of the said inner layer lamp shade top support frame to keep the circumferential rim of the said inner layer lamp shade top support frame tightly positioned in the said insertional offset slots and, as such, thereby achieving assembly and disassembly that is both convenient and rapid, furthermore, the said top and bottom rings as well as the said inner and outer layer lamp shades are all collapsible into a flat state to reduce storage and shipping dimensions and thereby effectively reduce shipping costs.

2. An improved structure rapid assembly/disassembly lamp shade in which an outer layer lamp shade rests on a plurality of support rods insertionally coupled to a bottom ring and, furthermore, the said support rods are upwardly whorl-folded relative to the axial center of the said bottom ring such that the said support rod top sections are inwardly against the bottom edge of the said outer layer lamp shade top ring, additionally, the said top support frame is disposed at the apex of the said inner layer lamp shade and, furthermore, the said top support frame provides for light bulb mounting, the features of which are: each said support rod is of a predetermined length that is slightly lower than that of the said lamp shade and, furthermore, a clip tab protrudes at the center of the uppermost curved rod of each said support rod such that after each said clip tab is admitted into a catch slot situated along the said top support frame, and thereby fitted into a receding edged, insertional retaining slot at the top end, as well as the assembly of the said support rods into the said outer layer lamp shade, the said insertional offset slot is formed in each of the said insertional retaining slots at the bottom edge of the said outer layer lamp shade top ring that provides for the engagement of the said inner layer lamp shade top support frame to thereby keep the circumferential rim of the said inner layer lamp shade top support frame tightly positioned in the said insertional offset slots.

3. An improved structure rapid assembly/disassembly lamp shade in which an outer layer lamp shade rests on a plurality of support rods having a length equal to that of the said lamp shade insertionally coupled to a bottom ring and, furthermore, the said support rods are upwardly whorl-folded relative to the axial center of the said bottom ring such that the said support rod top sections are inwardly against the bottom edge of the said outer layer lamp shade top ring, additionally, the said top support frame is disposed at the apex of the said inner layer lamp shade and, furthermore, the said top support frame provides for light bulb mounting, the features of which are: an elastic tab is sleeved onto the circumferential rim of the said outer layer lamp shade top ring at the position of every other said support rod, the said elastic tabs extend downward such that when the said inner lamp shade top support frame is upwardly engaged by insertion to the said top ring, the said top support frame is engaged at the lower extent of the said elastic tabs, and insertionally maintained in position on the said outer layer lamp shade.

* * * * *